US007071880B2

(12) United States Patent
Lee et al.

(10) Patent No.: US 7,071,880 B2
(45) Date of Patent: Jul. 4, 2006

(54) DUAL BAND PATCH ANTENNA

(75) Inventors: Ming-Chou Lee, Hsinchu (TW); Jan-Kwo Leeng, Hsinchu (TW); Tsung-Liang Lin, Hsinchu (TW)

(73) Assignee: MediaTek Incorporation, Hsinchu (TW)

( * ) Notice: Subject to any disclaimer, the term of this patent is extended or adjusted under 35 U.S.C. 154(b) by 0 days.

(21) Appl. No.: 10/908,025

(22) Filed: Apr. 26, 2005

(65) Prior Publication Data

US 2005/0237240 A1 Oct. 27, 2005

Related U.S. Application Data

(60) Provisional application No. 60/566,028, filed on Apr. 27, 2004.

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846
See application file for complete search history.

(56) References Cited

U.S. PATENT DOCUMENTS

| | | | | |
|---|---|---|---|---|
| 6,801,168 | B1 * | 10/2004 | Yeh | 343/700 MS |
| 6,822,610 | B1 * | 11/2004 | Yeh | 343/700 MS |
| 6,850,192 | B1 * | 2/2005 | Yeh | 343/700 MS |
| 2004/0017315 | A1 * | 1/2004 | Fang et al. | 343/700 MS |

* cited by examiner

*Primary Examiner*—Shih-Chao Chen
(74) *Attorney, Agent, or Firm*—Jianq Chyun IP Office

(57) ABSTRACT

An antenna structure has a substrate, having a first-side surface and a second-side surface. A first antenna substructure on the first-side surface has a first straight metal line and a second straight metal line. The second straight metal line joins to the first straight metal line, and is substantially perpendicular to the first straight metal line. A second antenna substructure disposed on the second-side surface has a metal plate, serving as a ground, wherein the first straight metal line is overlapping with the metal plate. An L-shape metal line protrudes from the metal plate, wherein a portion of the L-shape metal line is parallel and overlapping with the second straight metal line, and a portion of the L-shape metal line is parallel to the first straight metal line without overlapping.

20 Claims, 13 Drawing Sheets

2.45G x-z plane

| | E-phi | E-theta |
|---|---|---|
| max | -0.801 | -0.821 |
| average | -5.69 | 7.87 |

Unit:dBi

2.45G y-z plane

| | E-phi | E-theta |
|---|---|---|
| max | 1.200 | -3.130 |
| average | -0.701 | -9.942 |

Unit:dBi

2.45G x-y plane

| | E-phi | E-theta |
|---|---|---|
| max | 1.204 | -14.345 |
| average | -2.500 | -25.218 |

Unit:dBi

5.25G x-z plane

| | E-phi | E-theta |
|---|---|---|
| max | -0.186 | -0.798 |
| average | -3.089 | -9.085 |

Unit:dBi

5.25G y-z plane

| | E-phi | E-theta |
|---|---|---|
| max | 3.934 | -0.714 |
| average | 1.163 | -7.162 |

Unit:dBi

5.25G x-y plane

| | E-phi | E-theta |
|---|---|---|
| max | 3.791 | -8.261 |
| average | -1.471 | -19.094 |

Unit:dBi

DUAL BAND PATCH ANTENNA

CROSS-REFERENCE TO RELATED APPLICATION

This application claims the priority benefits of U.S. provisional application titled "DUAL BAND INVERTED-E ANTENA" filed on Apr. 27, 2004, Ser. No. 60/566,028. All disclosure of this application is incorporated herein by reference

BACKGROUND OF THE INVENTION

1. Field of Invention

The present invention relates to an antenna structure. More particularly, the present invention relates to an antenna structure on a circuit board for dual band operation.

2. Description of Related Art

The communication technology has been well developed and plays an important role in the daily life. Particularly, the wireless telecommunication is an important way to communicate with a person in moving terminal. For example, the cellular phone is very popular now in wireless communication. Antenna in wireless communication is the necessary element to transmit and receive the radio frequency (RF) signal.

Antenna implemented into the communication device for transmitting or receiving RF signals by various ways. However, in order to have adapt into the communication device in a compact way, antenna can be directly form on a substrate, such as a printed circuit board, which can directly connect to the electronic circuit of the transceiver. Also and, in order to have the more choice to communicate, the electronic circuit is designed to be able to operate in dual-band mode. In this manner, the antenna should also be able to be operated in dual-band mode. The dual-band operation occurs quite often. For example, the cellular phone at different area is operated in different frequency band. However, the same antenna is used in these two frequency bands.

Since the structure of the antenna will determine the response efficiency for the specific frequency band, the antenna structure is still under designed to be adapted into various communication device. For the manufacturers, how to design the proper antenna, particularly to the cellular phone, is still in development. The easy structure with acceptable performance is more strongly desired when the dimension of the communication device is further reduced.

SUMMARY OF THE INVENTION

The invention provides a novel antenna structure, suitable for use in dual-band communication mode. The antenna structure is directly formed on a substrate, such as a printed circuit board, at both sides by a simplified structure.

According to the invention, the antenna structure has a substrate, having a first-side surface and a second-side surface. A first antenna substructure on the first-side surface has a first straight metal line and a second straight metal line. The second straight metal line joins to the first straight metal line, and is substantially perpendicular to the first straight metal line. A second antenna substructure disposed on the second-side surface has a metal plate, serving as a ground, wherein the first straight metal line is overlapping with the metal plate. An L-shape metal line protrudes from the metal plate, wherein a portion of the L-shape metal line is parallel and overlapping with the second straight metal line, and a portion of the L-shape metal line is parallel to the first straight metal line without overlapping.

According to another aspect of the invention, the first antenna substructure of the foregoing antenna structure further comprises a third straight metal line, which is parallel to the first straight metal line and disposed at one side of the first straight metal line opposite to the second straight metal line. An electrical via in the substrate is used to electrically connect the third straight metal line and the L-shape metal line.

According to another aspect of the invention, in the foregoing antenna structure, the second antenna substructure further comprises a fourth straight metal line, protruding from the ground plate and being parallel to the third straight metal line. The third straight metal line and the fourth straight metal line are not overlapped but extend along a same straight line.

According to further another aspect of the invention, the antenna structure comprises a substrate, having a first-side surface and a second-side surface. A first antenna substructure is disposed on the first-side surface, wherein the first antenna substructure comprises a first L-shape metal line with a first-part line and a second-part line joined at a point potion. A second antenna substructure is disposed on the second-side surface. The second antenna substructure comprises a metal plate serving as a ground, wherein a portion of the first-part line of the first L-shape metal line is overlapping with the metal plate. The second antenna substructure further comprises a second L-shape metal line, extending out from the metal plate. Wherein, a portion of the L-shape metal line is parallel and overlapping with the second-part line, and a portion of the L-shape metal line is parallel to the first-part line of the first L-shape metal line.

According to further another aspect of the invention, the foregoing antenna structure further comprises a first straight metal line on the first-side surface, parallel to the first-part line of the first L-shape metal line without overlapping with the metal plate, and located at an opposite side to the second-part line with respect to the first-part line. A virtual L-shape can be formed from the first straight metal line and the second-part line when the second-part line virtually extends to the straight metal line. The straight metal line is electrically connected to the second L-shape metal line by an electric via in the substrate.

According to further another aspect of the invention, the antenna structure further comprises a second straight metal line on the second-side surface, which is protruding from the ground plate and being parallel to the first straight metal line. The first straight metal line and the second straight metal line are not overlapped but extend along a same straight line.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

In the invention, a novel antenna structure is proposed, which can be used in dual-band operation. In the following descriptions, embodiments are provided as the examples for description but the invention is not limited to the embodiments.

Figure 1C:
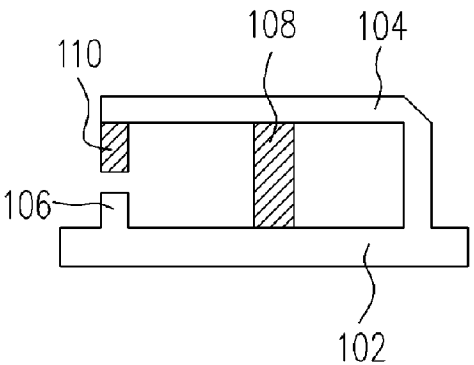
FIGS. 1B–1C are top and bottom transparent views, schematically illustrating an antenna structure on a circuit substrate in FIG. 1A.
Figure 1B:
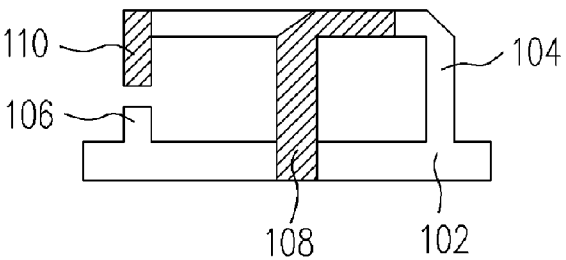
Figure 1A:
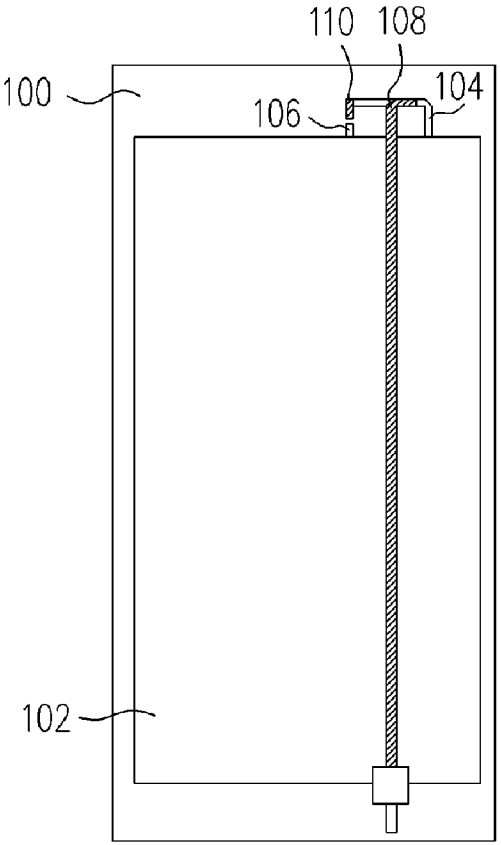
FIG. 1A is a planar transparent view, schematically illustrating an antenna structure on a circuit substrate, according to the invention.

FIG. 1A is a planar transparent view, schematically illustrating an antenna structure on a circuit substrate, according to the invention. In FIG. 1A, a substrate 100, such as a printed circuit board, is shown. The antenna structure is formed on surfaces of both sides. For easy understanding, the substrate 100 is shown by a transparent way, so that the structure on surfaces of both sides can be seen. FIGS. 1B–1C are top and bottom transparent views, schematically illustrating an antenna structure on a circuit substrate in FIG. 1A. The shaded elements are the first antenna substructure on one side surface of the substrate 100 (see FIG. 1B), and the other elements the second antenna substructure on the other side of the substrate 100 (see FIG. 1C).

Referring to FIGS. 1A–1C, in detail, the first antenna substructure includes the metal line 108 and optionally includes the metal line 110 on one side of the substrate 100, as shown in FIG. 1B. The second antenna substrate includes the metal plate 102 and the L-shape metal line 104 as shown in FIG. 1C. Optionally, the second antenna substrate further includes the protruding part 106. The metal line 108 has one end at the radiation end and one end, as shown in box, is used to connect to an external circuit (not shown) for transmitting or receiving signals.

Figure 2:
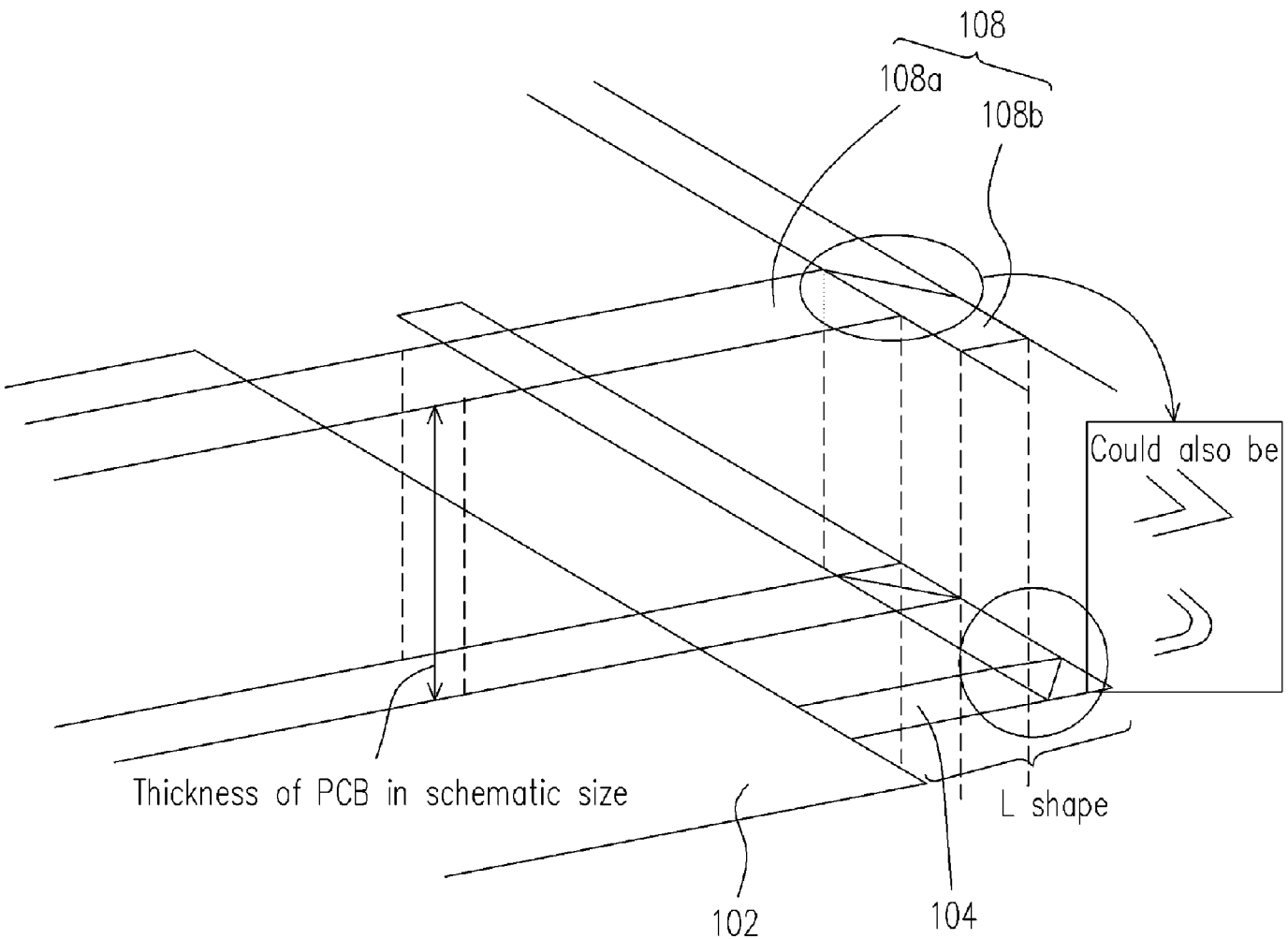
FIG. 2 is a sectional perspective view, schematically illustrating the antenna structure, according to a first embodiment of the invention.

FIG. 2 is a sectional perspective view, schematically illustrating the antenna structure, according to a first embodiment of the invention. In FIG. 2, the printed circuit board (PCB) is shown by a space but not actually drawn. As a result, the first antenna substructure 108 and the second antenna substructure are separated into two levels on two side surfaces of the PCB. The first antenna substructure 108 includes a metal line 108*a* and a metal line 108*b*, which are joined perpendicularly together. Preferably, the metal line 108*a* and the metal line 108*b* are a single metal layer in two portions. However, the joining corner can be a sharp angle, a smooth bending, or a cut-corner as shown in FIG. 2. Basically, the first antenna substructure 108 is an L-shape structure. One end with the metal line 108*b* is the radiating end, and the opposite end is used for example receive the signal to transmitted or passing the signal, received by the antenna, to the signal processing circuit (not shown).

For the second antenna substructure, it includes the metal plate 102, which preferably is square or rectangular. The metal plate 102 serves as a ground plate in operation. An L-shape metal line 104 is protruding from the metal plate 102. The joining corner is also similar to the joining cornet of the L-shape between the metal line 108*a* and the metal line 108*b* as a sharp angle, a smooth bending, or a cut-corner.

It should be noted that, a portion of the metal line 108*a* is overlapping with the metal plate 102. Here, the meaning of overlapping is with respect to the view direction perpendicular to the metal plate 102. This definition of "overlapping" maintains for this whole specification and in claims, except the specific mention. Also and the L-shape has the substantially perpendicular intersection, according to the actual fabrication. As a result, the other portion of the metal line 108*a* is extending out from the metal plate 102. The metal line 108*b* is parallel to and overlapping with one line part of the L-shape metal line 104, so that the signal coupling can be in better performance. Preferably, the line widths of the metal line 108*a* and the L-shape metal line 104 at the overlapping portion are the same. In FIG. 2, the thinner lines and dashed lines are used to have the position references but not the actual antenna body. It is consistent with the drawing in FIG. 1B and FIG. 1C.

Figure 3:
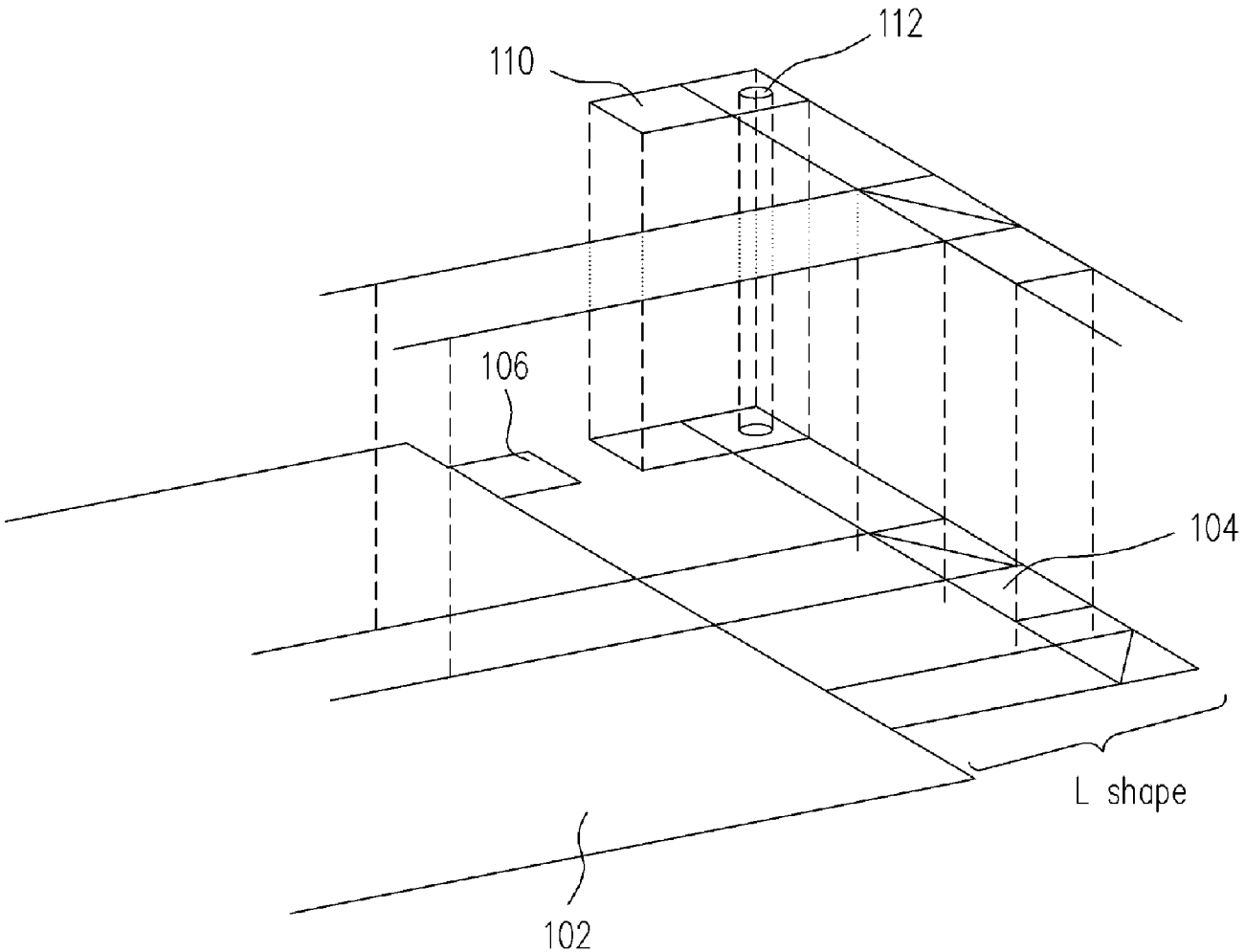
FIG. 3 is a sectional perspective view, schematically illustrating the antenna structure, according to a second embodiment of the invention.

FIG. 3 is a sectional perspective view, schematically illustrating the antenna structure, according to a second embodiment of the invention. In FIG. 3, the additional parts are the protrusion part 106, the metal line 110 and the electrical via 112 in the substrate 100.

The first antenna substructure further includes the metal line 110 which is parallel to the metal line 108*a*. The outer end of the metal line 110 is overlapping with one end of the L-shape metal line 104. An electric via 112 is formed in the substrate 100 (see FIG. 1) for electric connection the metal line 110 with the L-shape metal line 104. The position of the metal line 100 preferably is shown in FIG. 3, so that it can be substantially match to the L-shape metal line 104 at the opposite side of the substrate.

In order to have better performance with respect to the metal line 110, the protruding metal line 106 from the metal plate 102 can also be included in the second antenna substructure, which includes the metal plate 102, the L-shape metal line 104 and the protruding metal line 106. However, the protruding metal line 106 preferably is not overlapping with the metal line 110. However, they can also be overlapping in other design choice.

In the foregoing structures, the metal line 108 includes two portions 108*a*, 108*b* in electric coupling. However, the two portions can form a single body. Likewise, the second antenna substructure is preferably also a single body. The bending corners for the two antenna substructures, basically, can be any suitable shape. The drawings are the preferred examples. The metal line 108 is also an L-shape metal line but in different length and direction for the straight portions. Also and, the separation of the metal line 110 from the metal line 118 preferably is determined by the portion of the L-shape metal line 104 parallel to the edge of the metal plate 102. As a result, from the top view (FIGS. 1A–1C), the first antenna substructure and the second antenna substructure are in well overlapping to have well performance to have inverted-E structure.

Figure 4:
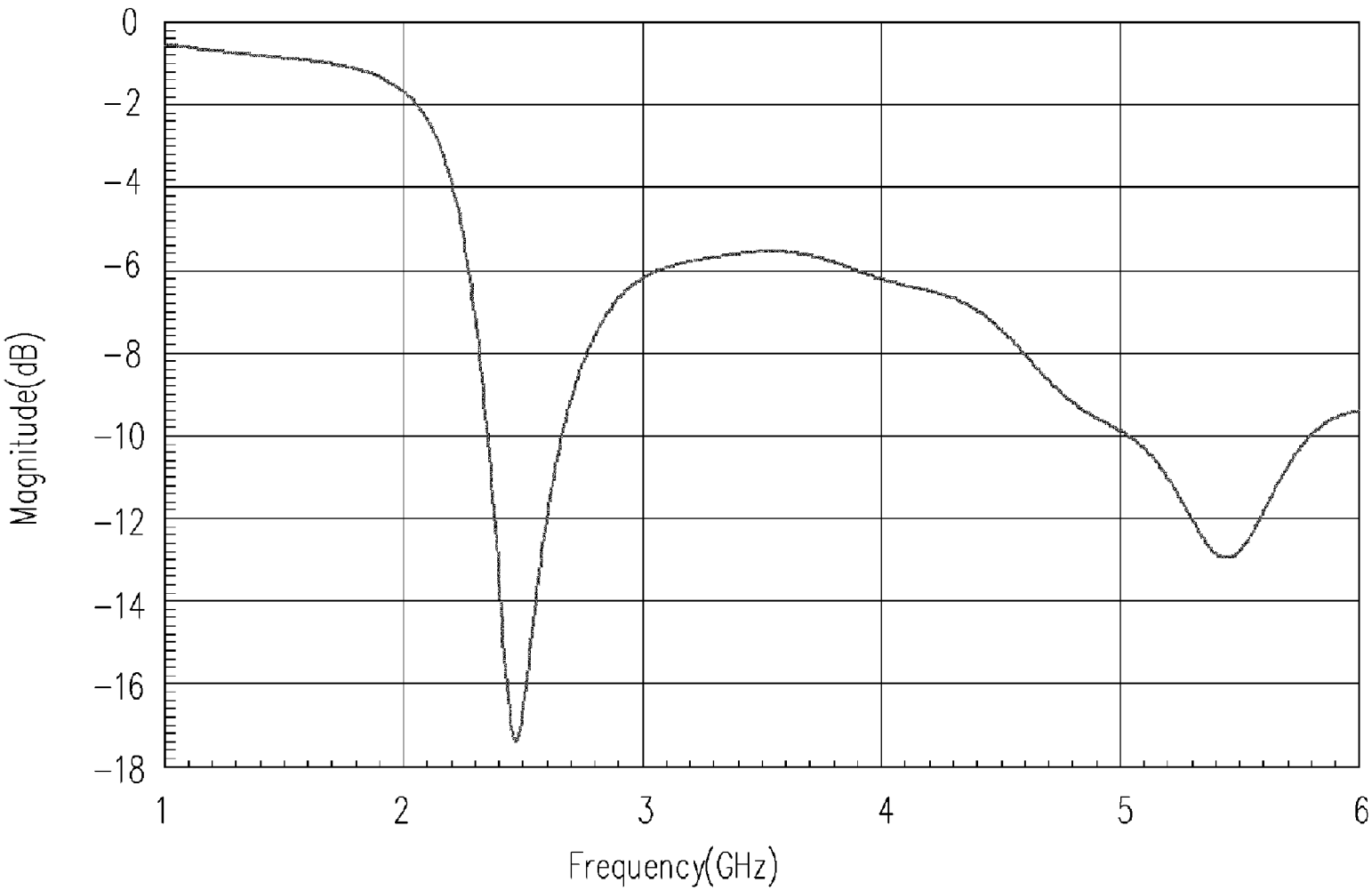
FIG. 4 is a drawing, schematically illustrating a simulation result of the antenna structure about energy lost with respect to frequency for the antenna of FIG. 3, according to the invention.
Figure 5:
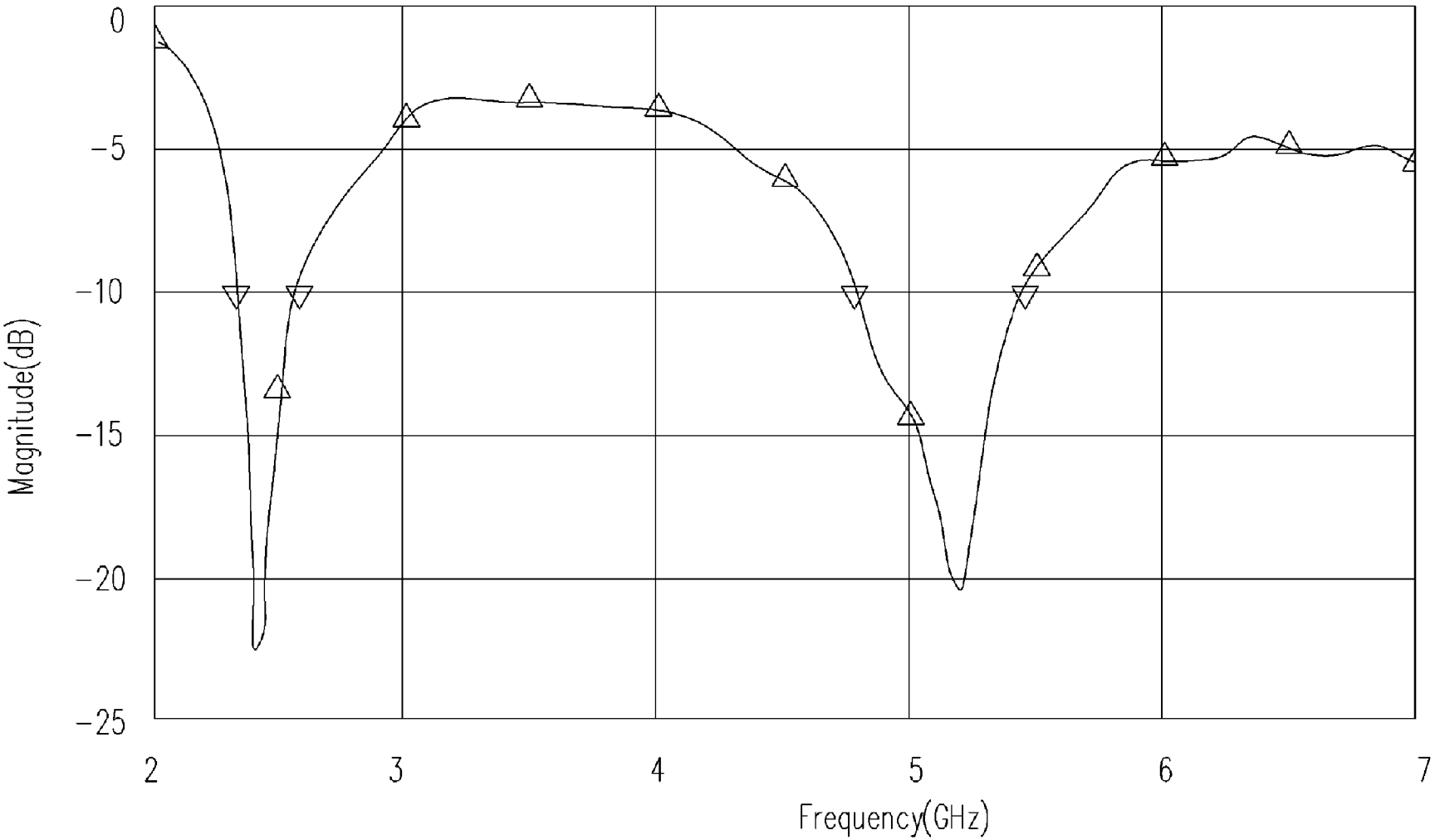
FIG. 5 is a drawing, schematically illustrating a measured data with respect to the antenna in FIG. 3.

FIG. 4 is a drawing, schematically illustrating a simulation result of the antenna structure about energy lost with respect to frequency for the antenna of FIG. 3, according to the invention. FIG. 5 is a drawing, schematically illustrating a measured data with respect to the antenna in FIG. 3. In FIG. 4, two frequency bands at about 2.5 and 5.4 GHz are expected to be operated in dual band. In FIG. 5, the measurement is taken as indicated by points. Two frequency bands can be achieved.

Figure 6:
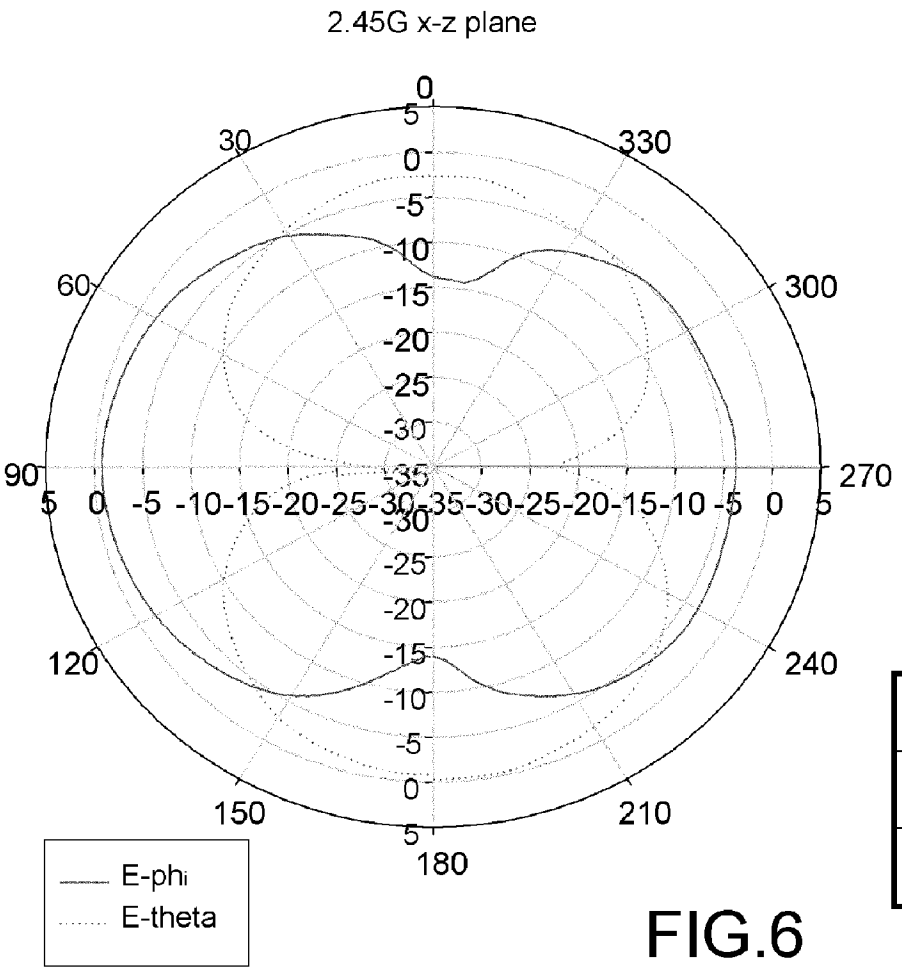
FIGS. 6–11 are drawings, schematically illustrating the simulated radiation patterns in different observing plane with respect to two operated frequency bands, according to the invention.
Figure 6:
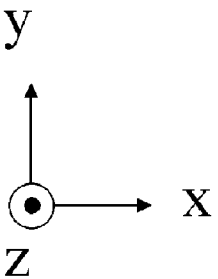
Figure 7:
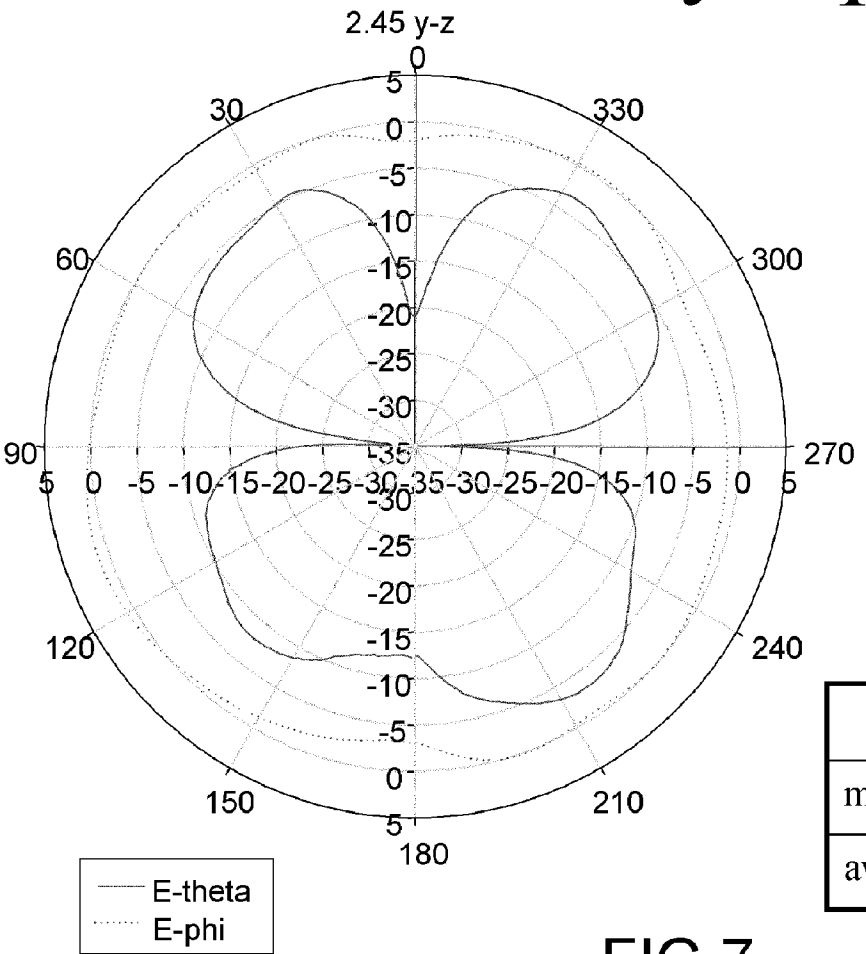
Figure 7:
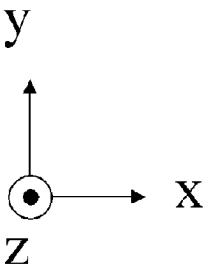
Figure 8:
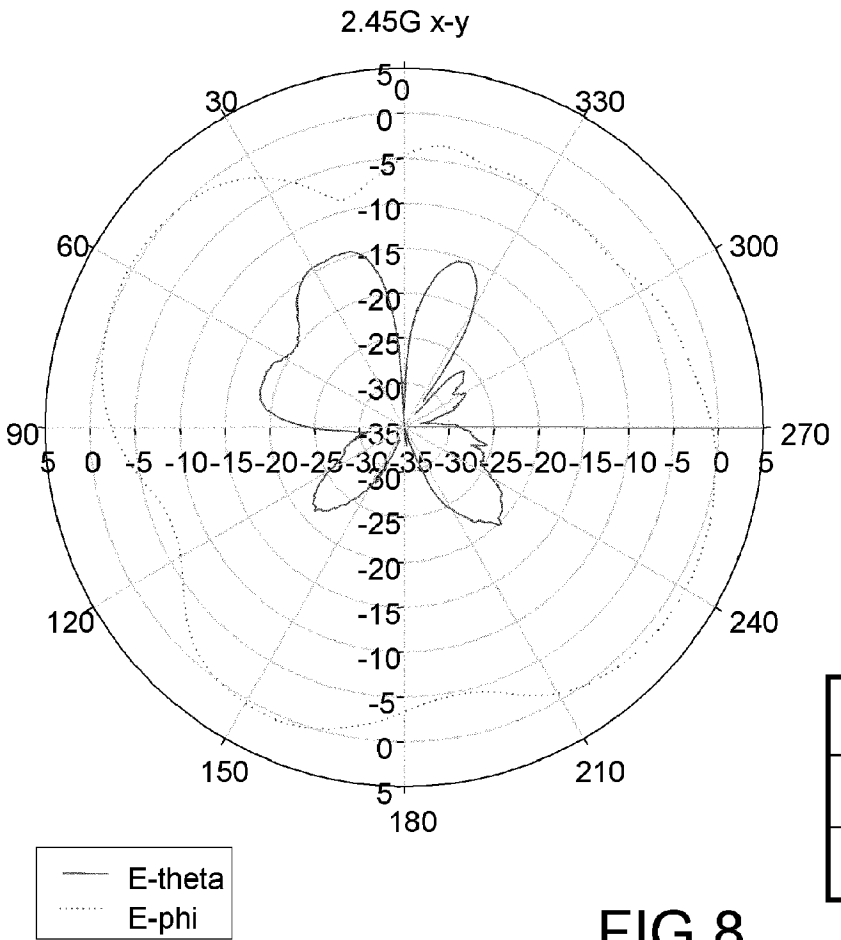

FIGS. 6–11 are drawings, schematically illustrating the simulated radiation patterns in different observing plane with respect to two operated frequency bands, according to the invention. In FIGS. 6–8, the operation frequency is about at 2.45 GHz. The electric field in theta and phi angles on the X-Z plane, Y-Z plane and X-Y plane are shown. The solid line represents the electric field in phi, and the dotted line represents the electric field in theta. The data show that the design of the novel antenna can be well operated as an antenna.

Figure 9:
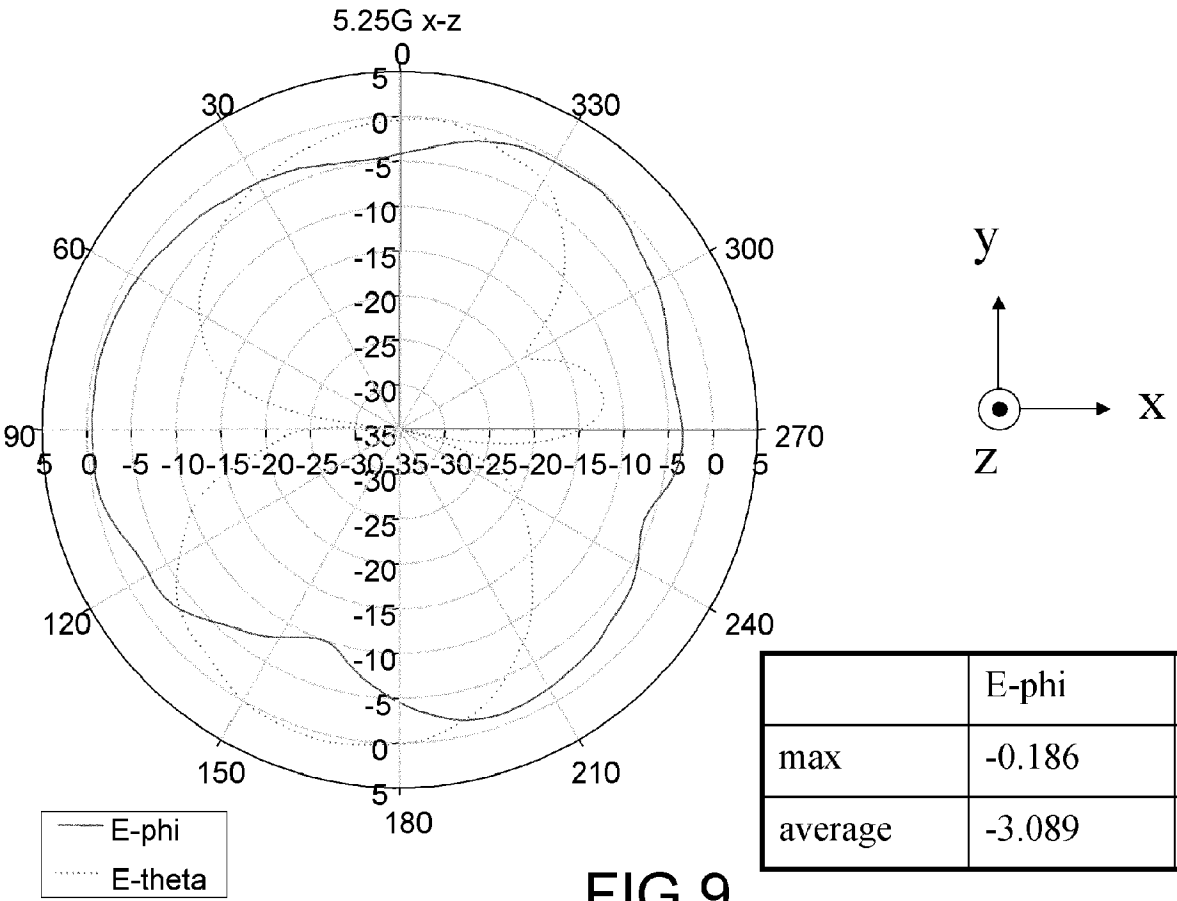
Figure 10:
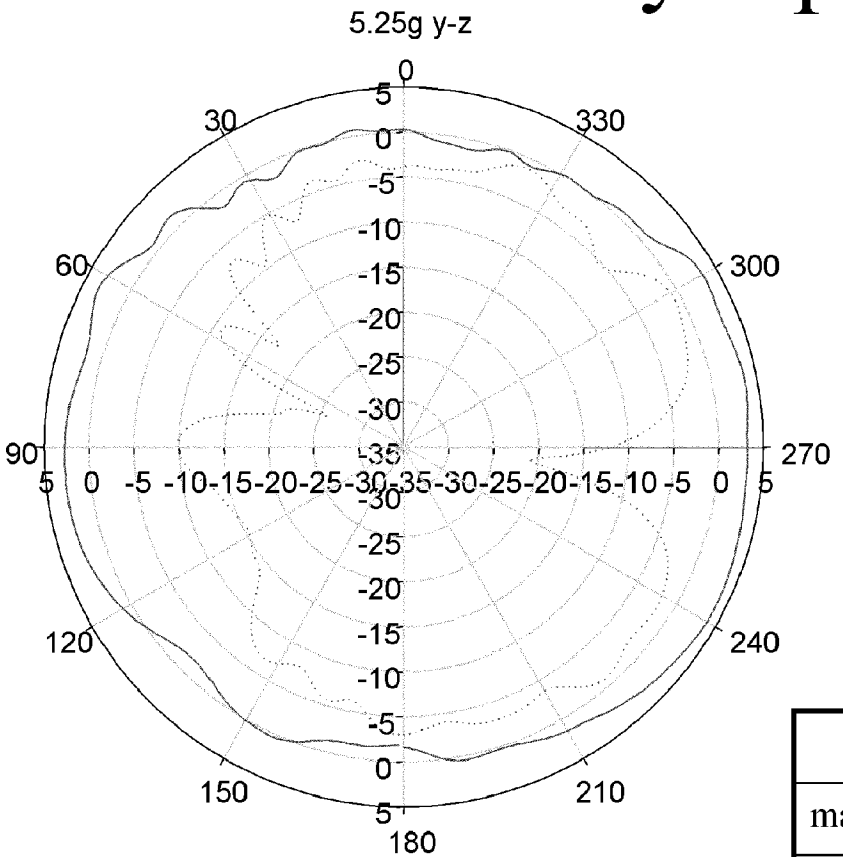
Figure 10:
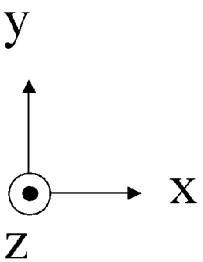
Figure 11:
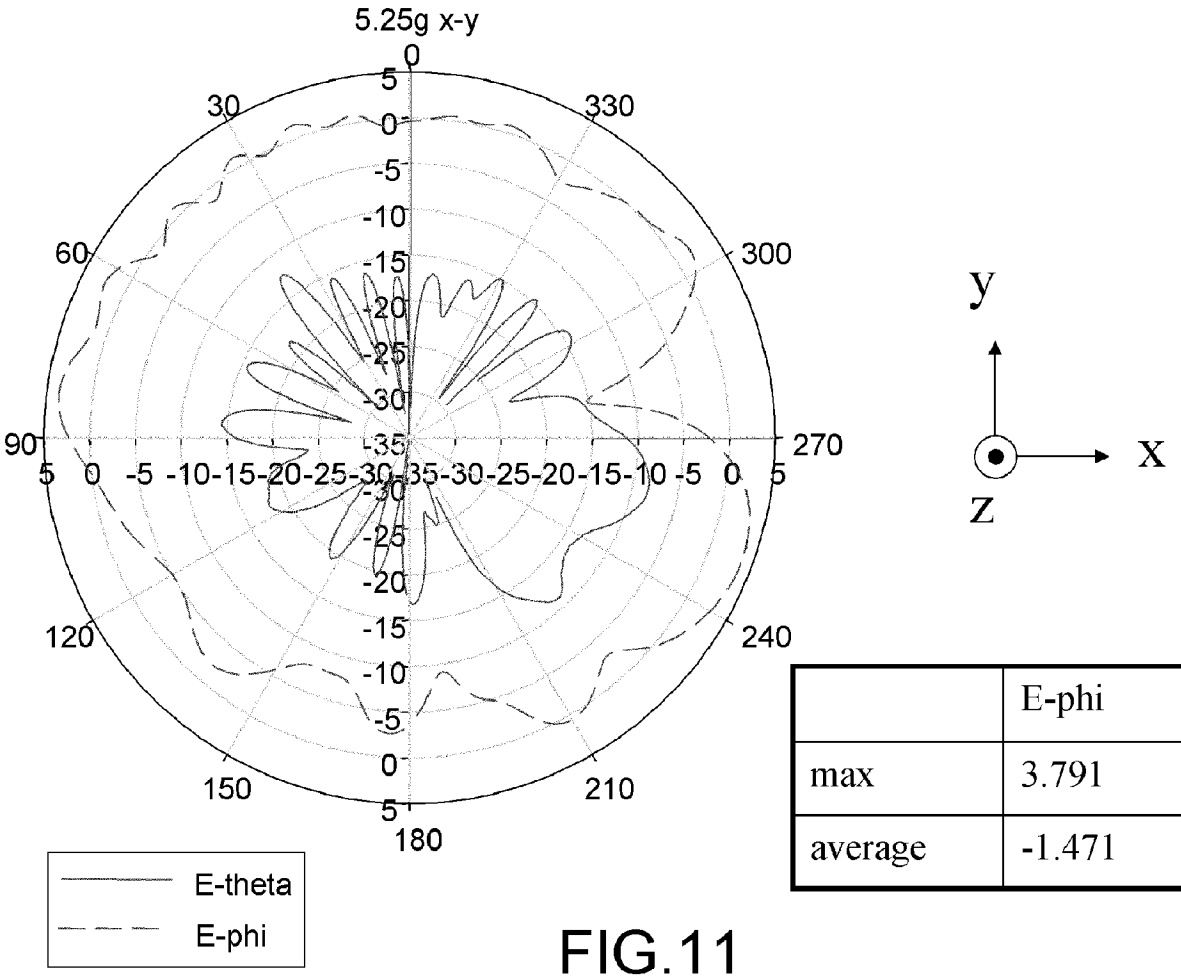

Since the novel antenna is preferably used in dual-band operation, the same antenna structure is verified at the frequency of about 5.25 GHz. In FIGS. 9–11, the electric filed is verified in theta and phi angles on different planes, similar to FIG. 6-8. Again, according to the data, the novel antenna can be operated at the frequency band about at 5.25 GHz. As a result, the antenna achieves the dual-band operations.

Figure 12:
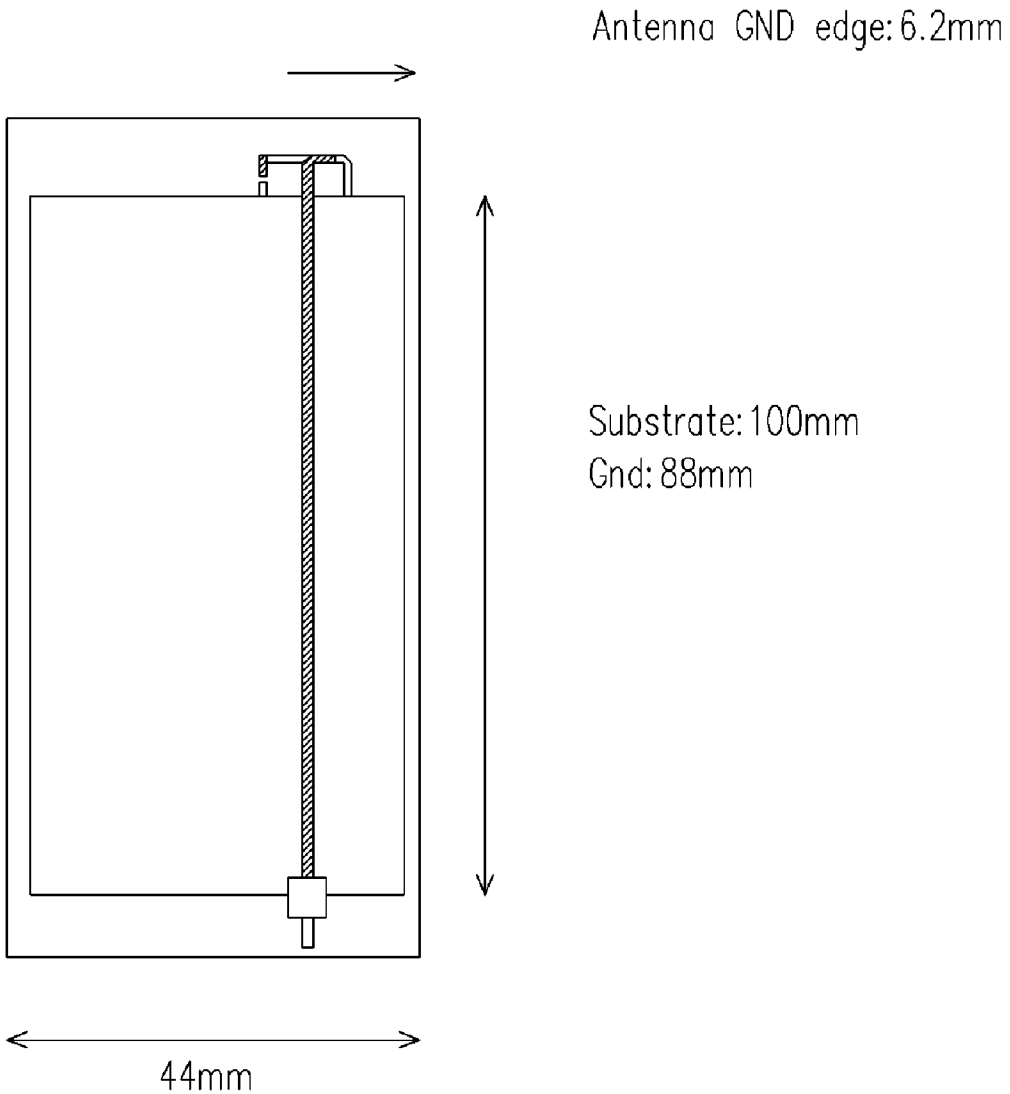
FIGS. 12–13 are drawing, schematically illustrating the actual size for the antenna structure as an example, according to the invention.
Figure 13:
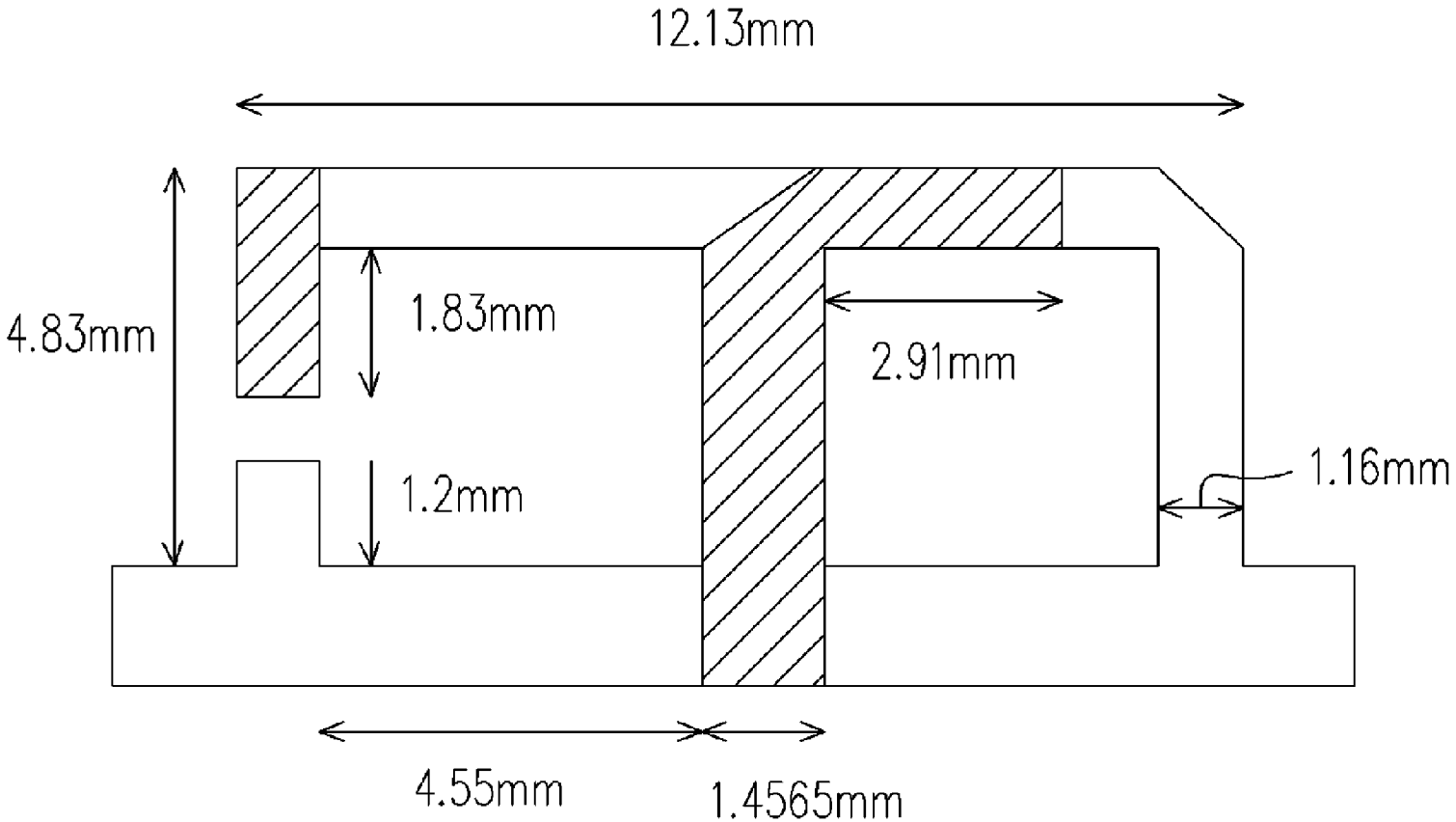

FIGS. 12–13 are drawings, schematically illustrating the actual size for the antenna structure as an example, according to the invention. The actual size of the antenna structure as the example is shown. In FIG. 12, the rectangular substrate, such as a PCB, has a size of 44 mm by 100 mm, so as to adapt the antenna. The metal plate is also rectangular with longer side by 88 mm. Edge of the metal plate to the edge of the substrate is 6.2 mm. In FIG. 13, the portion of the antenna protruding from the metal plate region is further shown in detail. The shaded portion belongs to the first antenna substructure on one side surface of the substrate, while the second antenna substructure is on the other side surface of the substrate. The size is an example but is not the only choice. The actual size can be adjusted with respect to the desired operation frequencies. The bending structure is the cut-corner bending as the example. The bending angle preferably is perpendicular bending. In general view, the antenna is also called inverted-E antenna with respect to the portion other thane the grounding portion.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. An antenna structure, suitable for a dual-band operation, the antenna structure comprising:

a substrate, having a first-side surface and a second-side surface;

a first antenna substructure, disposed on the first-side surface, wherein the first antenna substructure comprises:

a first straight metal line, wherein the straight metal line has one end as an external connection end, and another end as a radiating end; and a second straight metal line, joining to the first straight metal line at the radiating end, substantially perpendicular to the first straight metal line; and a second antenna substructure, disposed on the second-side surface, wherein the second antenna substructure comprises:

a metal plate, serving as a ground plate, wherein the first straight metal line is overlapping with the metal plate; and a L-shape metal line, protruding from the metal plate, wherein a portion of the L-shape metal line is parallel and overlapping with the second straight metal line, and a portion of the L-shape metal line is parallel to the first straight metal line without overlapping.

2. The antenna structure of claim 1, wherein the first antenna substructure further comprises a third straight metal line, parallel to the first straight metal line, and disposed at one side of the first straight metal line opposite to the second straight metal line, an electrical via in the substrate is used to electrically connect the third straight metal line and the L-shape metal line.

3. The antenna structure of claim 2, wherein the second antenna substructure further comprises a fourth straight metal line, protruding from the ground plate and being parallel to the third straight metal line, wherein the third straight metal line and the fourth straight metal line are not overlapped but extend along a same straight line.

4. The antenna structure of claim 1, wherein in the first antenna substructure, the second straight metal line is joined to the first straight metal line by a joint structure by a sharp-angle bending, a smooth bending, or a cut-corner bending.

5. The antenna structure of claim 1, wherein in the second antenna substructure, a corner of the L-shape metal line is a joint structure by a sharp-angle bending, a smooth bending, or a cut-corner bending.

6. The antenna structure of claim 1, wherein the ground plate is a square shape or a rectangular shape.

7. The antenna structure of claim 1, wherein the substrate is a printed circuit board.

8. The antenna structure of claim 1, wherein the first straight metal line and the second straight metal line of the first antenna substructure are in a single metal line.

9. The antenna structure of claim 1, wherein the overlapping portion between the L-shape metal line and the second straight metal line doesn't necessary has a same line width.

10. The antenna structure of claim 1, wherein the antenna structure is operated in a dual-band frequency, wherein a length of the first antenna substructure is about a quarter wavelength of a higher frequency and a length of the second antenna substructure is about a quarter wavelength of a lower frequency.

11. An antenna structure, suitable for use in a dual-band operation, the antenna structure comprising:

a substrate, having a first-side surface and a second-side surface;

a first antenna substructure, disposed on the first-side surface, wherein the first antenna substructure comprises a first L-shape metal line with a first-part line and a second-part line joined at a point portion;

a second antenna substructure, disposed on the second-side surface, wherein the second antenna substructure comprises:

a metal plate, serving as a ground, wherein a portion of the first-part line of the first L-shape metal line is overlapping with the metal plate; and a second L-shape metal line, extending out from the metal plate, wherein a portion of the second L-shape metal line is parallel and overlapping with the second-part line of the first L-shape metal line, and a portion of the L-shape metal line is parallel to the first-part line of the first L-shape metal line without overlapping.

12. The antenna structure of claim 11, further comprising:

a first straight metal line on the first-side surface, parallel to the first-part line of the first L-shape metal line without overlapping with the metal plate, located at an opposite side to the second-part line with respect to the first-part line, and a virtual L-shape can be formed from the first straight metal line and the second-part line when the second-part line virtually extends to the straight metal line, wherein the straight metal line is electrically connected to the second L-shape metal line by an electric via in the substrate.

13. The antenna structure of claim 12, further comprising:

a second straight metal line on the second-side surface, protruding from the ground plate and being parallel to the first straight metal line, wherein the first straight metal line and the second straight metal line are not overlapped but extend along a same straight line.

14. The antenna structure of claim 11, wherein a joint portion of the first L-shape metal line is a sharp-angle corner, a smooth bending corner or a cut corner.

15. The antenna structure of claim 11, wherein a joining corner of the second L-shape metal line is a sharp-angle corner, a smooth bending corner or a cut corner.

16. The antenna structure of claim 11, wherein the ground plate is a square shape or a rectangular shape.

17. The antenna structure of claim 11, wherein the substrate is a printed circuit board.

18. The antenna structure of claim 11, wherein the first-part line and the second-part line of the first antenna substructure are in a single metal line.

19. The antenna structure of claim 11, wherein the overlapping portion between the second L-shape metal line and the second-part line of the first L-shape metal line doesn't necessary has a same line width.

20. The antenna structure of claim 11, wherein the antenna structure is operated in a dual-band frequency, wherein a length of the first antenna substructure is about a quarter wavelength of a higher frequency and a length of the second antenna substructure is about a quarter wavelength of a lower frequency.

* * * * *